US007019462B2

(12) United States Patent
Okamoto et al.

(10) Patent No.: US 7,019,462 B2
(45) Date of Patent: Mar. 28, 2006

(54) SEALING AGENT FOR A FOIL SEALED LAMP

(75) Inventors: Toshiyuki Okamoto, Hyogo (JP); Yukiharu Tagawa, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/823,567

(22) Filed: Apr. 14, 2004

(65) Prior Publication Data

US 2004/0201352 A1 Oct. 14, 2004

(30) Foreign Application Priority Data

Apr. 14, 2003 (JP) ..... 2003-109326

(51) Int. Cl.
*H01J 17/16* (2006.01)

(52) U.S. Cl. ..... 313/634

(58) Field of Classification Search ..... 313/623–625, 313/634, 635; 445/25–27; 264/61; 65/31–33
See application file for complete search history.

(56) References Cited

U.S. PATENT DOCUMENTS 4,766,346 A 8/1988 Weiss et al.
4,835,439 A 5/1989 Essock et al.
6,495,960 B1 * 12/2002 Takeji et al. ..... 313/634
6,635,993 B1 * 10/2003 Niimi ..... 313/623
6,646,379 B1 * 11/2003 Nohara et al. ..... 313/623
6,724,144 B1 * 4/2004 Takeji et al. ..... 313/634
6,744,206 B1 * 6/2004 Miura et al. ..... 313/634

FOREIGN PATENT DOCUMENTS

JP 62-272454 A 11/1987
JP 01-163956 A 6/1989

* cited by examiner

*Primary Examiner*—Joseph Williams
*Assistant Examiner*—Dalei Dong
(74) *Attorney, Agent, or Firm*—Rader, Fishman & Grauer PLLC

(57) ABSTRACT

In a foil sealed lamp, a lamp container made of transparent material, has at least one sealing portion made of molybdenum wherein a metallic foil is buried, a light emitting section which is connected to one end of the metallic foil and a lead rod extending outward and connected to other end of the metallic foil, and wherein, in the sealing portion, a gap formed around a circumference portion of the lead rod is filled with sealing agent made of rubidium oxide or cesium oxide, and glass having boron oxide and bismuth oxide as principal components is coated on an outer end surface of the sealing portion so as to close the gap.

2 Claims, 6 Drawing Sheets

| | Comparative Example 1 | Comparative Example 2 | Comparative Example 3 | Comparative Example 4 | Comparative Example 5 | Example according to the invention |
|---|---|---|---|---|---|---|
| Sealing Agent | N/A | N/A | alkali metal silicate | alkali metal silicate | rubidium oxide | rubidium oxide |
| Presence of Blockage Portion | No | Yes | No | Yes | No | Yes |
| Test A (550 °C) | 110 Hours | 210 Hours | 370 Hours | 550 Hours | 700 Hours | 2570 Hours |
| Test B (500 °C) | 420 Hours | 620 Hours | 550 Hours | 970 Hours | 1500 Hours | 3500 Hours |

Fig. 6

SEALING AGENT FOR A FOIL SEALED LAMP

TECHNICAL FIELD OF THE INVENTION

The present invention relates to a lamp having a structure in which a metallic foil made of molybdenum is air-tightly sealed in a sealing portion(s) of a lamp container having a light emitting portion and the sealing portion(s) and made of transparent material, and more specifically, to a lamp in which the sealing portion(s) reaches a high temperature when the lamp is turned on.

DESCRIPTION OF RELATED ART

As a lamp having a foil seal structure in which a metallic foil made of molybdenum is buried in the sealing portion(s), for example, an incandescent light bulb and a discharge lamp are known. A discharge lamp in which a foil seal structure is adopted can be classified into several types of lamps in view of a light emitting substance and/or pressure in an arc tube. In view of the light emitting substance, there are a mercury lamp containing mercury as a light emitting substance, a metal halide lamp containing a mixture of metal vapor and a dissociation product of halide as a light emitting substance, and the like. In view of the pressure in the arc tube, there are a low pressure discharge lamp and a high pressure discharge lamp etc.

Of these lamps, the high pressure discharge lamp comprises a quartz glass discharge container having a light emitting portion and sealing portions formed at the respective sides of the light emitting portion, metallic foils made of molybdenum, which are buried in the respective sealing portions, a pair of electrodes extending into the light emitting portion each of which is connected to one end of the metallic foil, and a lead rod extending outward which is connected to the other end of the metallic foil.

Further, in the discharge container, mercury is encapsulated as a light emitting substance so that vapor pressure is greater than $10^5$ Pa when the lamp is turned on. Specifically, in case of a super high pressure mercury lamp for a liquid crystal projector, there are some advantages such as realization of a point light source or miniaturization of the device.

Recent years, the demands on the miniaturization of liquid crystal projectors and high illumination increase. With this, since such super high pressure mercury lamps themselves become miniaturized, and in such lamps, high illumination is realized, there is tendency of a temperature rise in each part. Improvements of heat-resistance of each part are expected. Of those, a super high pressure mercury lamp having a sealing portion(s) with high heat resistance and a longer use life is expected.

In an operation of sealing a sealing portion of a lamp having a foil seal structure, due to the difference of expansion coefficient between the quartz glass constituting the sealing portion(s) and molybdenum or tungsten constituting the lead rod, a minute gap or space is formed between the sealing portion(s) and a circumference portion of the lead rod.

Since such a gap is formed, air enters and reaches the surface of the metallic foils of the lamp sealing portions and the lead rods, oxidization of the metallic foils and the lead rods is considerably accelerated in case that the temperature of the metallic foils and the lead rods becomes greater than 350 degrees Celsius at time of lighting. As a result, the sealing portions are cracked, or the metallic foils are melt due to the oxidization of the metallic foils and the lead rods thereby causing breakdown of the lamp at an early stage.

To solve the problems, in an incandescent light bulb or a metal halide lamp, metallic foils and lead rods are coated with alkali metal silicate by applying an aqueous solution of alkali metal silicate to a gap or space formed between the sealing portion and the circumference surface of the lead rod at each end of the lamp so that oxidization of a lead rods and the metallic foils are reduced. See, for example, Japanese Patent No. 7-105212.

As another example to solve the problems, in a halogen lamp, oxidization of the metallic foils and the lead rods is reduced by filling low-melting glass filler made of lead oxide, bismuth oxide, and boron oxide. See, for example, Japanese Patent No. 7-19582.

However, the technology disclosed in Japanese Patent Number 7-105212 has a problem that it takes a fairly long time at a relatively low temperature to dry the aqueous solution of alkali metal silicate. That is, although during the drying process the viscosity of the aqueous solution of alkali metal silicate gradually becomes high and in the last result becomes a glassy coat, moisture and/or gas may be trapped in the high viscous glassy coat where a drying temperature is too high, or where drying time is too short. In this case, a heat-resistant temperature of the sealing portions may not be improved and a lifetime of the sealing portions it may not be extended.

Moreover, according to the technology disclosed in Japanese Patent No. 7-19582, there is a problem that in order to acquire good flowability, it is necessary to heat the sealing portions to a large extent in a process of filling with low-melting glass a gap formed between the sealing portion and the outer surface of a lead rod.

Furthermore, since the low-melting glass filler contains lead oxide, it is not desirable in view of environmental issues.

Furthermore, when the lamp according to the technology disclosed in Japanese Patent No. 7-105212, was put in an electric furnace, which was continuously operated at 500 to 550 degrees Celsius, and a heat-resistant test of sealing portions was performed, the following problems arose:

When the heat-resistant test was performed at 500 degrees Celsius and 550 degrees Celsius, the average lifetime (MTTF) of the sealing portions of the lamp was 550 hours and 370 hours, respectively.

Therefore, with the technology disclosed in Japanese Patent No. 7-19582, the sealing portions whose temperature reaches greater than 500 degree Celsius while the lamp is turned on, cannot have a sufficient heat-resistant temperature and a use lifetime.

SUMMARY OF THE INVENTION

It is an object of the present invention to provide a lamp having high heat-resistant temperature and a long use lifetime.

It is another object of the present invention to prevent oxidization of a metallic foil and a lead rod.

According to the present invention, at least one of the objects is achieved by a foil sealed lamp in which a lamp container made of transparent material, has at least one sealing portion made of molybdenum wherein a metallic foil is buried, a light emitting section which is connected to one end of the metallic foil and a lead rod extending outward and connected to the other end of the metallic foil, wherein, in the sealing portion, a gap formed around a circumference portion of the lead rod is filled with sealing agent made of rubidium oxide or cesium oxide, and glass having boron oxide and bismuth oxide as principal components is coated on an outer end surface of the sealing portion so as to close the gap.

Further, according to the present invention, at least one of the objects of the present invention is achieved by a foil sealed lamp in which a lamp container made of transparent material, has at least one sealing portion made of molybdenum wherein a metallic foil is buried, a light emitting section which is connected to one end of the metallic foil and a lead rod extending outward and connected to other end of the metallic foil, the foil sealed lamp, wherein in the sealing portion, a gap formed around a circumference portion of the lead rod is filled with an aqueous solution of rubidium nitrate or cesium nitrate, and a heat-treatment of the sealing portion is carried out so as to form sealing agent made of rubidium oxide or cesium oxide in the sealing portion, and glass having boron oxide and bismuth oxide as principal components is coated on an outer end surface of the sealing portion so as to dose the gap.

Furthermore, according to the present invention, at least one of the objects is achieved by a method of manufacturing a foil sealed lamp, the method comprising the following steps of filling a gap formed around a lead rod in a sealing portion with an aqueous solution of rubidium nitrate or cesium nitrate, separating out rubidium nitrate or cesium nitrate by drying the aqueous solution, coating an outer end surface of the sealing portion with glass powder having boron oxide and bismuth oxide as principal components so as to close the gap, and pyrolyzing the rubidium nitrate and cesium nitrate in order to generate sealing agent made of rubidium oxide or cesium oxide by and, at the same time, melting the glass so as to form a blockage portion.

The lamp according to the present invention, has a structure in which a gap formed on an outer surface of the lead rod is filled with sealing agent made of rubidium oxide or cesium oxide, and glass comprising boron and oxide bismuth oxide as main components is attached to an outer end surface of the sealing portion(s) thereby closing an entrance of air on the outer end surface of the sealing portion(s). According to such a structure, since the lead rod(s) and foil(s), which are exposed to the oxidation environment, are sufficiently shut out from outside air, a heat-resistant temperature of sealing portion is improved. Furthermore, it is possible to extend the use lifetime in a high temperature.

The present invention will become more apparent from the following detailed description of the embodiments and examples of the present invention.

DESCRIPTION OF THE DRAWINGS

FIG. 6 is a table that shows the average lifetime obtained by analyzing data of average lifetime associated with the lamps of the experiment according to the present invention.

DETAILED DESCRIPTION OF THE INVENTION

Figure 1:
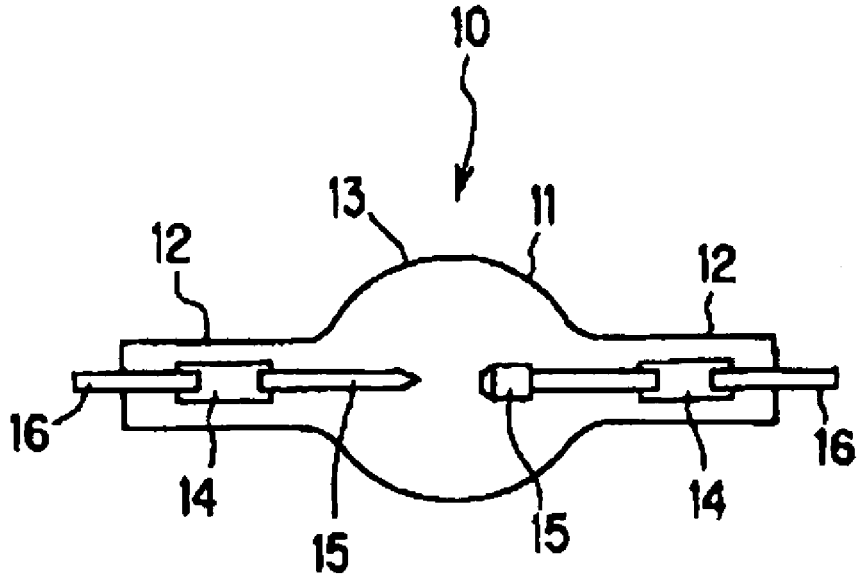
FIG. 1 is a diagram explaining the structure of a lamp according to the present invention.

FIG. 1 is a diagram explaining the structure of a lamp according to the present invention.

A discharge lamp 10 has a discharge container 13 made of quartz glass and comprising a light emitting portion 11, and sealing portions 12 which are formed at both end of the light emitting portion 11. Each of the sealing portions 12 is air tightly sealed so as to bury a metallic foil 14 made of molybdenum. A pair of electrodes 15 are extended into the light emitting portion 11, each of which is connected to one end of each metallic foil 14. The other end of each metallic foil 14 is connected to a lead rod 16 made of molybdenum or tungsten so that the lead rod 16 extends outward from an end surface of the sealing portion 12. Furthermore, in a discharge container 13, 150 to 350 mg/cc mercury is enclosed as a light emitting substance.

Figure 2:
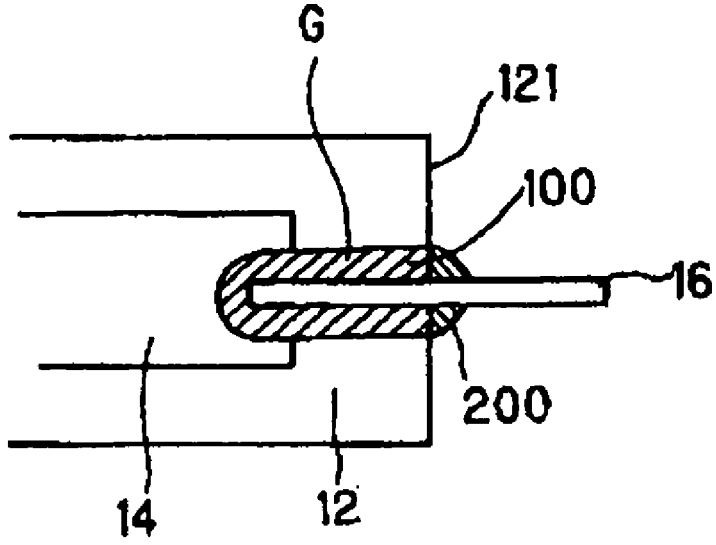
FIG. 2 is an enlarged view of one of the sealing portions in the lamp according to the present invention.

FIG. 2 is an enlarged view of one of the sealing portions 12 in the lamp according to the present invention.

A gap G formed between the sealing portion 12 and the outer surface of the lead rod 16 is filled with sealing agent 100 made of rubidium oxide. Furthermore, a circumference portion of the lead rod 16 where the rod 16 crosses an outer end surface 121 of the sealing portion 12 is covered with a blockade portion 200 made of low-melting glass whose main components are boron oxide and bismuth oxide.

Figure 3:
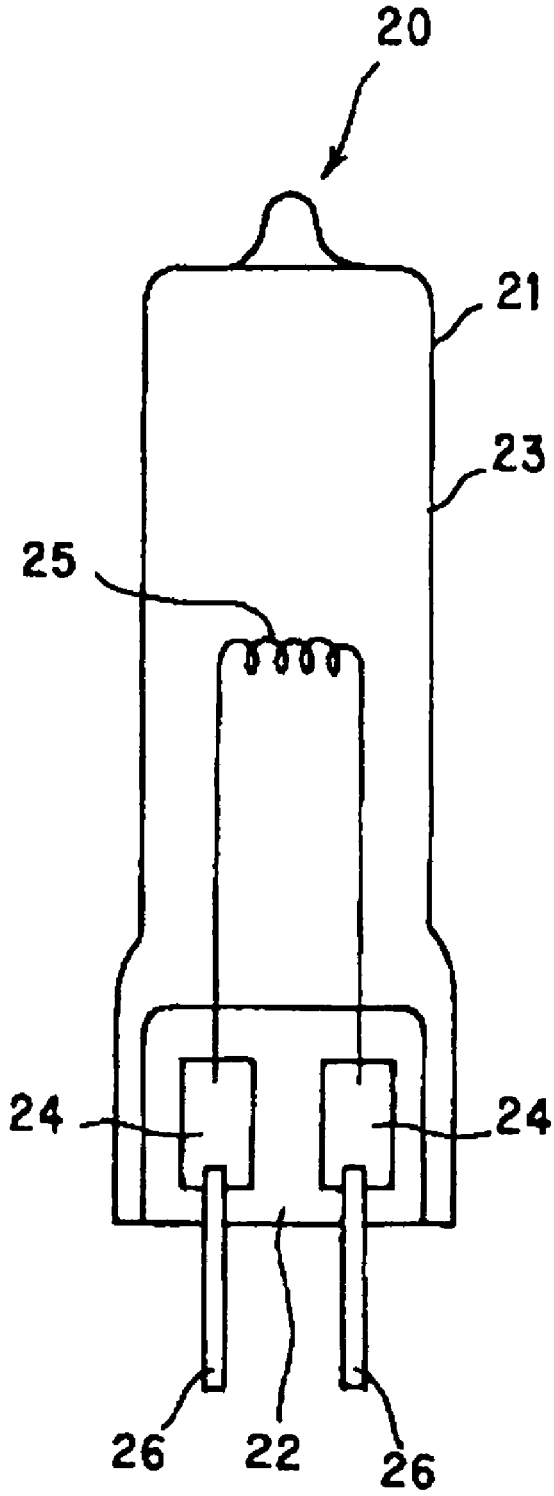
FIG. 3 is a diagram explaining the structure of another lamp according to the present invention.

FIG. 3 is a diagram explaining the structure of another lamp according to the present invention.

An incandescent light bulb 20 has a lamp container 23 made of quartz glass and comprising a light emitting portion 21 and a sealing portion 22. As the material of the lamp container, hard glass may be used. The sealing portion 22 is air tightly sealed and a metallic foils 24 made of molybdenum is buried therein. A filament 25 made of tungsten is connected to one end of the metallic foils 24, and lead rods 26 made of molybdenum or tungsten is connected to the other end of the metallic foils 24.

In addition, since the structure of the sealing portion 22 is the same as that shown in FIG. 2, the detailed explanation is omitted.

A manufacturing method of the lamp according to the present invention is explained below.

FIGS. 4A, 4B, 4C and 4D are diagrams explaining a series of steps from filling of sealing agent to formation of a blockade portion in the discharge lamp 10 shown in FIG. 1.

<Injection Process>

Figure 4A:
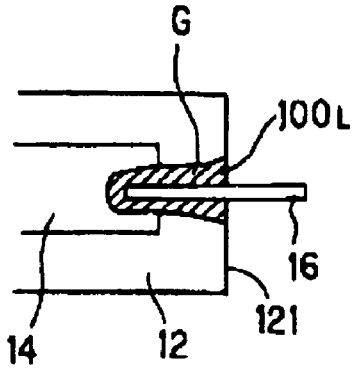
FIGS. 4A, 4B, 4C and 4D are diagrams explaining a process from filling of a sealing agent to formation of a blockade portion in the discharge lamp shown in FIG. 1.

FIG. 4A is a diagram explaining an injection process.

An aqueous solution $\mathbf{100}_L$ of rubidium nitrate whose concentration is adjusted is dropped around a circumference portion of the lead rod 16 where the sealing portion 12 crosses the outer end surface (face) 121 by an injector, so that the entire gap is filled with the aqueous solution by capillary phenomenon. This process is carried out about both sealing portions 12.

<Dryness Process>

Figure 4B:
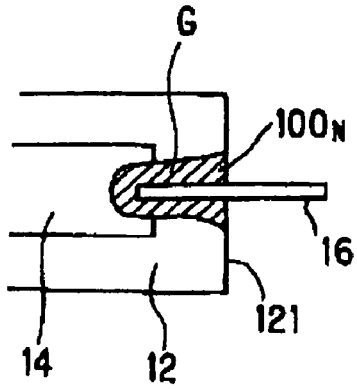

FIG. 4B is a diagram explaining a drying process.

When the lamp whose gap G has been filled with the aqueous solution $\mathbf{100}_L$ is put, for 10 minutes, in the furnace where the temperature is retained at 150 degrees Celsius so as to be dried, moisture evaporates and rubidium nitrate $\mathbf{100}_N$ is generated.

The moisture, which is evaporated, is discharged to outside of the sealing portions 12.

<Application Process>

Figure 4C:
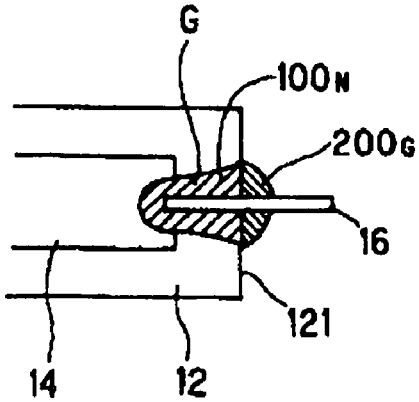

FIG. 4C is a diagram explaining an application process.

Proper quantity of paste-like glass 200G which is made by adding appropriate solvent and comprises boron oxide and bismuth oxide as main components is applied around a portion where the lead rod 16 of the lamp whose gap G is filled with the rubidium nitrate 100N crosses the outer end face 121.

<Sealing Process>

Figure 4D:
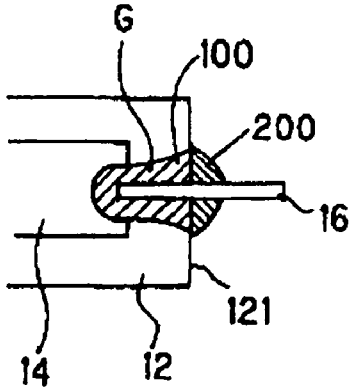

FIG. 4D is a diagram explaining a sealing process.

In the lamp in which the gap G is filled with the rubidium nitrate $\mathbf{100}_N$, an appropriate amount of paste-like glass $\mathbf{200}_G$ comprising boron oxide and bismuth oxide as main components and made by adding an appropriate solvent is applied around a portion where the lead rod 16 of the lamp crosses the outer end face 121 of the sealing portion 12.

In the lamp in which a gap G is filled with the rubidium nitrate $\mathbf{100}_N$, and the glass $\mathbf{200}_G$ which comprises boron oxide and bismuth oxide as main components, is coated around the outer surface of the portion where the lead rod 16 crosses the outer end surface 121, NOx gas is discharged outside the sealing portion 12 by heating the sealing portion 12 by a hydrogen burner, thereby generating sealing agent 100 made of rubidium oxide and, at the same time, melting the glass $\mathbf{200}_G$. After heating the sealing portion 12, the melted glass $\mathbf{200}_G$ is naturally cooled down so that it is solidified thereby forming the blockade portion 200.

Although rubidium nitrate $\mathbf{100}_N$ requires high temperature to be pyrolytically decomposed, it is possible to check that rubidium nitrate $\mathbf{100}_N$ has reached the pyrolysis temperature by checking visually that the glass $\mathbf{200}_G$ is melt.

The aqueous solution of the rubidium nitrate is explained concretely.

Purified water and the rubidium nitrate is checkweighed so that the concentration of the aqueous solution becomes 2 mol/litter, and then rubidium nitrate is dissolved in the purified water.

Since when concentration of the aqueous solution of rubidium nitrate exceeds 2.5 mol/litter, rubidium nitrate may be separated out, and when it is less than 0.5 mol/litter, the sealing agent with which the gap between the sealing portion and the lead rod is filled is too little to fully acquire the antioxidant effect to the lead rod and the metallic foil, the concentration is preferably in a range of 0.5 to 2.5 mol/litter. However, the concentration thereof in the present invention is not limited to that range, and therefore, it may be greater than 2.5 mol/litter or less than 0.5 mol/litter.

Here, since rubidium oxide is a stable compound even at high temperature and does not erode the metallic foils and the lead rods even if the sealing portions becomes high temperature at the time of lamp lighting, rubidium oxide is desirable as sealing agent.

Moreover, the reason for having used the aqueous solution of rubidium nitrate as a start substance is that a rubidium oxide can be easily generated with heat treatment.

In addition, in the above-mentioned manufacturing method, the aqueous solution of cesium nitrate may be used as a start substance so as to easily generate sealing agent made of cesium oxide.

The reason for having used rubidium and cesium among alkali metals as a sealing agent is explained below.

It is known that when an alkali metal moves in quartz glass, the quartz glass is eroded.

The factor to determine the erosion degree is the mobility of alkali metal ions, which are obtained from the temperature of an area where the alkali metal ions exist, and since the higher the temperature in the area, the higher the mobility is, so that the erosion degree becomes higher.

Moreover, the ionic radii of an alkali metal is related to the mobility, and the mobility becomes higher as the ionic radii is smaller as compared with the size of the network structure of quartz glass. Therefore, among alkali metals, lithium, sodium, potassium ions, etc. have a small ionic radii compared with the size of the network structure of quartz glass, and therefore these ions easily move in the network structure.

That is, if these metals are used as a sealing agent, the degree of erosion of the quartz glass comprising the sealing portions 12 and the light emitting portion 11 is thought to be high.

On the contrary, since rubidium ions are larger as compared with the size of the network structure of the quartz grass, the mobility is small and the degree of erosion of the quartz glass is small. Of course, like cesium ions, even if an alkali metal with a larger ionic radii than that of rubidium is used, the degree of erosion of quartz glass is thought to be small.

The low melting-glass having boron oxide and bismuth oxide as a principal component, which comprises the blockade portion, is explained below with reference to FIG. 2.

The glass of which the blockade portion 200 is made is applied around a portion where the lead rod 16 crosses an outer end face 121 of the sealing portion 12 so as to close the gap G.

Since when a state where the lamp is turned on is compared with a state where air cooling without blower is carried out after turning off the lamp, the temperature of sealing portion 12 differs in these states, the width of the opening of the gap G in these states differs depending on the heat expansion coefficient of the lead rod and quartz glass.

Therefore, as the glass, which closes the opening, low-melting glass that has moderate viscosity when the lamp is turned on, is preferably selected. Specifically, the DTA transition temperature may be preferably in the range of 370 to 550 degrees Celsius. It is not limited to that range in the present invention.

The DTA transition temperature differs depending on composition ratio of boron oxide and bismuth oxide, which are main components of the low-melting glass. Usually, as the DTA transition temperature becomes higher, the melting point is higher.

In addition, as for the low melting glass, which constitutes the blockage portion 200, the total weight of boron oxide and bismuth oxide which are the principal components is preferably 70% or more of the total weight of the low melting glass. However, it is not limited to 70% or more in the present invention.

Figure 5:
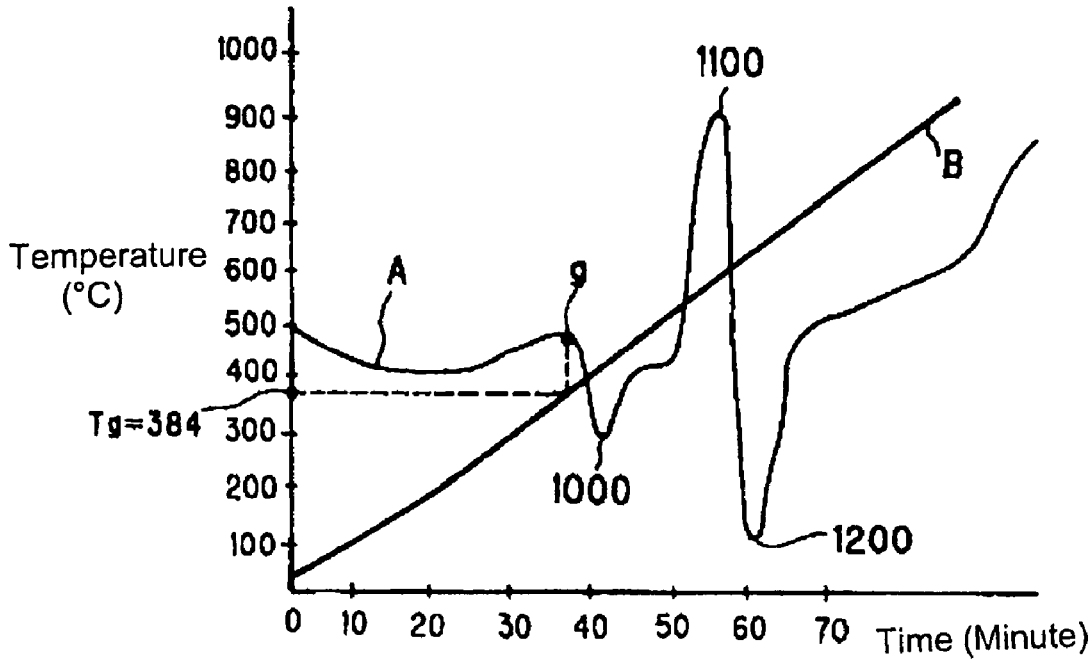
FIG. 5 is a graph to explain the DTA transition temperature of the low-melting glass which constitutes the blockage portion.

FIG. 5 is a graph to explain the DTA transition temperature of the low-melting glass which constitutes the blockage portion 200, and which is measured in a condition described below.

In FIG. 5, the horizontal axis shows time and a vertical axis shows temperature.

<Measurement Conditions>

Sample: Low-melting glass in which boron oxide and bismuth oxide are mixed at the weight ratio 1:6.

Reference Material: Alumina

Measurement temperature: 25 to 1000 degrees Celsius

Electric-furnace temperature rising rate: 10 degrees/minute

Measurement atmosphere: Nitrogen gas atmosphere (flow rate 50 ml/minute)

In FIG. 5, a curve line A shows the temperature difference of a sample and reference material, and a straight line B shows the temperature of the electric furnace.

The first peak 1000 and the third peak 1200 of the curved line A show an endothermic reaction. The second peak 1100 of the curved line A shows an exothermic reaction. These peaks show temperature difference between the sample and the reference material due to thermal change to the sample in the process of temperature rise in the electric furnace.

Since only the temperature of a sample will be left behind from constant speed temperature rise when an endothermic reaction takes place in the sample at a certain temperature, the temperature difference between the sample and the reference material arises thereby showing a valley-like peak.

If an exothermic reaction arises, contrary to the endothermic reaction, a mountain-like peak appears.

Since as the reference material, a material in which there is a little temperature difference is selected, if the thermal change of the sample does not take place, the temperature difference between the sample and the reference material does not arise so that a peak does not appear. And the temperature Tg (=384 degrees Celsius) at a base end portion g of the first peak 1000 is the DTA transition temperature.

In addition, this value is the DTA transition temperature in the above-mentioned sample, and if the composition ratio of $B_20_3$ and $Bi_20_3$ which are the principal components of the low melting glass is changed, the DTA transition temperature changes. Usually, as the DTA transition temperature becomes higher, a melting point also becomes higher.

The suitable range of a DTA transition temperature of the glass, which constitutes the blockade portion 200, is explained below.

When the DTA transition temperature exceeds 550 degrees Celsius, a heat treatment at higher temperature is necessary when the blockage portion 200 is formed, and therefore, since a large thermal load is applied to the sealing portions, there is possibility that the sealing portions 12 may be destroyed.

Furthermore, since the glass remains in a low viscous glass state and does not have flowability at the time of lamp lighting, there is a high possibility that it exfoliates from the outer end surface 121 by repeating turning on and off the lamp.

Specifically, since the lead rod 16 made of molybdenum, the sealing portions 12 made of quartz glass, and the blockade part 200 made of low-melting glass have different coefficients of thermal expansion, if their temperatures rise high at the time of lamp lighting, due to their expanding volume differences, the blockade part 200 is thought to exfoliate from the outside end surface 121.

When low-melting glass containing a lead as a component is used, although it is possible to control the DTA transition temperature to be low, the use of lead is not desirable, because of an environmental problems.

In the foil sealed lamp according to the present invention, it is possible to easily fill the gap G with the sealing agent 100 made of rubidium metal oxide by thermal decomposition of rubidium nitrate. Rubidium metal oxide is a compound which is stable at high temperature and it is possible to fill the gap G with it without intensely eroding both of them by reaction with the metal foil 14 and lead rod 16.

Furthermore, since the blockade portion 200 is formed on the outer end surface 121 of the sealing portion 12 by coating the outer circumference of a portion where the lead rod 16 crosses the outer end surface of the sealing portion 12, it is possible to reduce air and moisture entering to the sealing portions from the opening portion of the gap G.

The glass which constitutes the blockage portion 200 has a low melting point, and if sealing portion 12 becomes high temperature at the time of lamp lighting, since the glass has moderate viscosity, it is possible to effectively prevent oxidization of the metallic foils and the lead rods by adhering to the outer end surface 121 of the sealing portions and the portion where the lead rod 16 crosses the outer end face 121 of the sealing portion 12.

Moreover, since the opening of the gap G is closed by glass, it is possible to prevent erosion of the metallic foils and the lead rods by the strong-basic aqueous solution of the rubidium hydroxide which is generated by reaction of the moisture in the air and the rubidium oxide with which the gap G has been filled. Furthermore, the mechanical strength of the lamp is improved near the portion where the lead rod crosses the outer end face 121 of the sealing portion 12.

According to the manufacturing method of the foil sealed lamp according to the present invention, in the injection process, since rubidium nitrate is injected in the gap G between the outer circumference of the sealing portion 12 and the lead rod 16 in the state of an aqueous solution, it is possible to easily fill the gap with rubidium nitrate by using capillary phenomenon. Thereby, it is possible to fill the gap G in all corners with the sealing agent 100 made of rubidium oxide after passing through a drying process, an application process, and a sealing process.

In case that a powder type sealing agent is used, since the width of the opening portion of the gap around the lead rod 16 of the sealing portion 12 is approximately 0.5 μm, it is difficult to fill the gap with the power type sealing agent because the particle size is too large to fill the gap with it.

Furthermore, in a drying process, it is possible to easily remove the moisture from the aqueous solution $\mathbf{100}_L$ of the rubidium nitrate at 150 degrees Celsius for a short time such as about 10 minutes.

Furthermore, in the sealing process, it is possible to remove the moisture and gas by using the pyrolysis of rubidium nitrate at the temperature of approximately 700 degrees Celsius for approximately 20 seconds. It is also possible to melt the low-melting glass for a short time.

The lamp made in order to conduct the first experiment, which confirms the effect of this invention is explained.

<Example According to the Present Invention>

In the first experiment, sixty six (66) lamps for experiment, which were produced by the above described manufacturing method, had the structure shown in FIG. 1 and had the size described later, each of which had sealing portions made of quartz glass and lead rods made of molybdenum wherein each gap between the sealing portion and the outer circumference of the lead rod was filled with sealing agent made of rubidium oxide thereby forming a blockage portion around the outer end surface of the sealing portion were prepared. (16 lamps for test at 500 degrees Celsius, 50 lamps for test at 550 degree Celsius)

<Comparative Example 1>

According to the structure shown in FIG. 1 and the size described later, seventeen (17) lamps for the experiment, in each of which a gap was not filled with sealing agent and no blockage portion was formed, were produced. (8 lamps for test at 500 degrees Celsius and 9 lamps for test at 550 degrees Celsius)

<Comparative Example 2>

According to the structure shown in FIG. 1, fifteen (15) lamps, in each of which gaps were not filled with sealing agent and blockage portions was formed, were prepared. (5 lamps for test at 500 degrees Celsius and 10 lamps for test at 550 degrees Celsius).

<Comparative Example 3>

According to the structure shown in FIG. 1 and the size described later and further the technology disclosed in Japanese Paten Number 7-105212, nine (9) lamps, in each of which gaps were filled with sealing agent made of alkali metal silicate and no blockage portion was formed, were prepared. (4 lamps for test at 500 degrees Celsius and 5 lamps for test at 550 degrees Celsius).

<Comparative Example 4>

According to the structure shown in FIG. 1 and the size described later and further the technology disclosed in Japanese Paten Number 7-105212, sixty (60) lamps, in each of which gaps were filled with sealing agent made of alkali metal silicate and blockage portions were formed respectively, were prepared. (23 lamps for test at 500 degrees Celsius and 37 lamps for test at 550 degrees Celsius).

<Comparative Example 5>

According to the structure shown in FIG. 1 and the manufacturing method described above, nine (9) lamps, in each of which gaps were filled with sealing agent made of rubidium oxide and no blockage portion was formed, were prepared. (4 lamps for test at 500 degrees Celsius and 5 lamps for test at 550 degrees Celsius).

<The Lamp for an Experiment>

Maximum outer diameter of a light emitting but portion: 11.3 mm

Internal volume: 140 $mm^3$

Length of the sealing portion: 18 mm

Maximum outer diameter: 6 mm

Length of a lead rod: 40 mm

Outer diameter: 0.8 mm

Length of a lead rod: 40 mm

Outer diameter: 0.8 mm

Length of metallic foil: 14 mm

Width of metallic foil: 1.5 mm

The first experiment using the above-mentioned experiment lamps according to the present invention and comparative examples 1, 2, 3, 4, and 5 is explained.

In the experiment, each lamp for experiment was placed in an electric furnace where it was kept at a fixed temperature, and time until cracks arise in the sealing portion was measured.

Specifically, the lamps according to the present invention and the comparative examples 1, 2, 3, 4, and 5 were put in the electric furnace, and the furnace was continuously run at the fixed temperature, that is, 550 degrees Celsius (test A) or 500 degrees Celsius (test B).

These lamps were taken out every 24 hours to observe existence of the cracks in the sealing portions by a microscope, and time until cracks arose in sealing portion about each discharge lamp was measured.

FIG. 6 shows a table of the average lifetime (MTTF) which was obtained by analyzing data of average lifetime of the lamps for an experiment according to the present invention and the comparative examples 1, 2, 3, 4, and 5, using the Weibull probability paper and accumulation hazard paper.

The average lifetime means an average of time until the crack(s) occurred in the sealing portion according to the present invention and comparative examples 1, 2, 3, 4, and 5.

According to the result of Test A, the average lifetime of the lamps according to comparative examples 1, 2, 3, 4, and 5 and the example according to the present invention were 110 hours, 210 hours, 370 hours, 550 hours, 700 hours, and 2570 hours, respectively.

According to the results of Test B, the average lifetime of the lamps according to the comparative examples 1, 2, 3, 4, and 5 and the example according to the present invention were 420 hours, 620 hours, 550 hours, 970 hours, 1500 hours, and 3500 hours, respectively.

This result shows that average lifetime of the lamps according to the present invention increased much more than those of all the lamps according to comparative examples.

Moreover, from the result that the average lifetime of the lamp according to the present invention is longer than that according to the comparative example 4, it can be observed that use of the rubidium oxide as sealing agent makes the lifetime of the lamp longer than alkali metal silicate. Of course, the same effect is acquired even though sealing agent made of cesium oxide is used.

Therefore, if the technology according to the present invention is applied to a super high pressure mercury lamp for a liquid crystal projector, which requires a high heat-resistant temperature and a long-lifetime of the sealing portions, it is possible to prolong the use life of the lamp.

Of course, even if the technology of the present invention is applied to a discharge lamp, which has a sealing portion(s) with the foil seal structure and an incandescent light bulb other than a super high pressure mercury lamp, it is possible to make such a lamp with sealing portions having high heat-resistant temperature and a long life.

Figure 7:
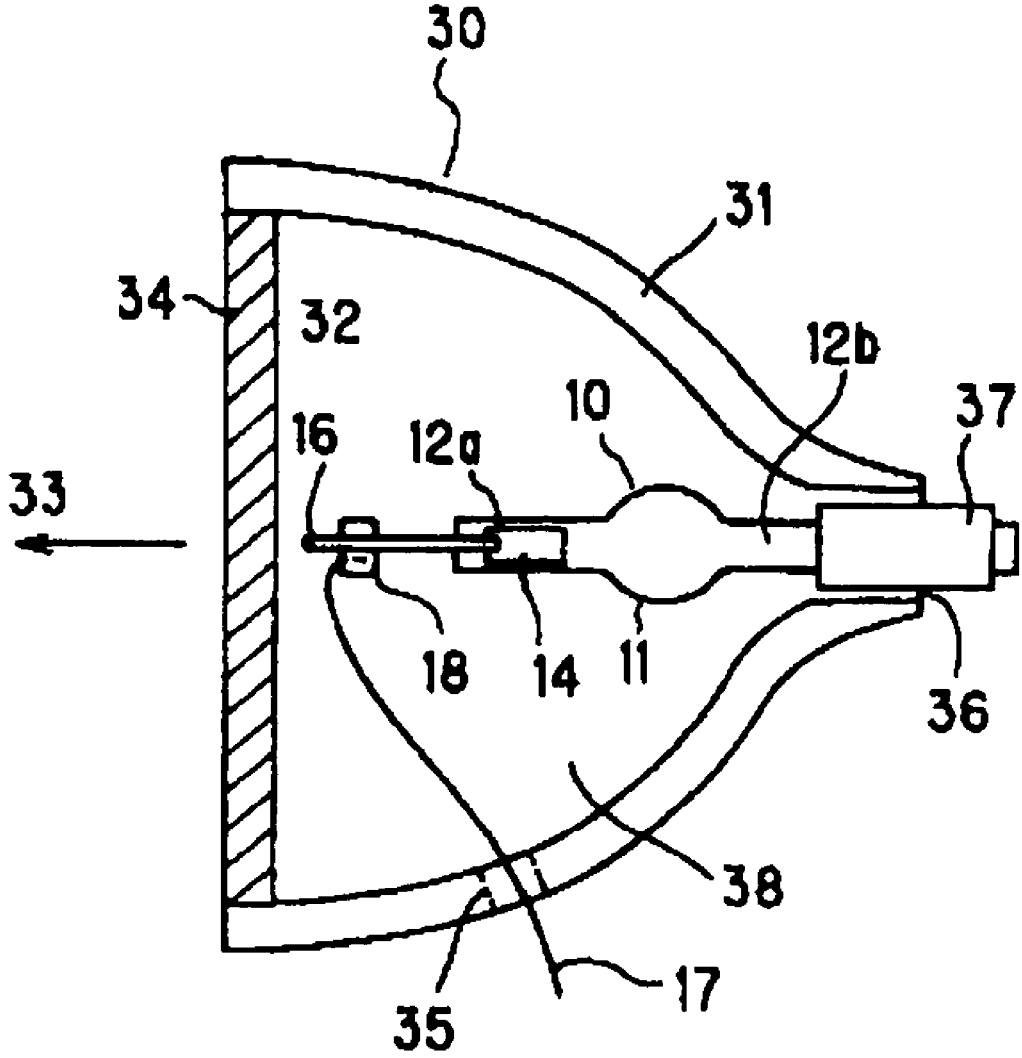
FIG. 7 shows a sectional view of the lamp unit in which a discharge lamp shown in FIG. 1 is disposed.

FIG. 7 shows a sectional view of the lamp unit 30 into which a discharge lamp 10 shown in FIG. 1 is built.

In the lamp unit 30, one of sealing portions 12*a* of the discharge lamp 10 is disposed on the side of an opening 32 of a reflector 31 (side of light emitting direction 33).

The other sealing portion 12*b* is projected from a top portion 36 (center hole) of the reflector 31, and is supported by the reflector 31 through adhesives. Moreover, a cap 37 is attached to an end portion of the sealing portion 12*b*. A reflector 31 has an opening 32 in the light emitting direction 33. Between the reflector 31 and a front glass 34, a sealed space 38 is formed by attaching front glass 34 to the opening 32. The lead rod 16 extending from the sealing portion 12*a*, and an electric supply line 17 are electrically connected to a holding member 18 by welding.

This electric supply line 17 passes through an opening 35 for an electric supply line formed on the reflector 31, extends outside the reflector 31 and further, is electrically connected to an external circuit not shown.

Since the lead rod 16 and the electric supply line 17 are connected as mentioned above, while a lamp unit 30 is conveyed, or the lamp is turned on, vibration of the electric supply line 17 is transmitted to the lead rod 16 thereby damaging the sealing portion 12*a* or causing a poor electrical connection due to disconnecting the lead rod 16 and metallic foil 14.

In the discharge lamp according to the present invention, since the blockage portion made of low-melting glass is provided on an outer end surface of the sealing portion 12*a* and a portion where the lead rod 16 crosses the outer end surface of the sealing portion is reinforced, even though while a lamp unit 30 is conveyed, or the lamp is turned on, vibration of the electric supply line 17 is transmitted to the lead rod 16, there is a low possibility that the sealing portion 12*a* is damaged or a poor electrical connection is caused.

In FIG. 7, since the discharge lamp 10 is disposed in the sealed space 38 formed between the reflector 31 and the front glass 34, temperature of the sealing portion 12*a* becomes high at the time of lamp lighting.

In particular, where the discharge lamp 10 is a super high pressure mercury lamp for a liquid crystal projector, the sealing portion 12*a* becomes higher temperature. Therefore, it is more effective if this invention is applied to the super-high-pressure mercury lamp disposed in the reflector.

The lamp produced in order to conduct the second experiment, which confirms the effect of the present invention, is explained.

<Example According to the Present Invention>

According to the structure shown in FIG. 1 and the manufacturing method described above, three (3) discharge lamps in each of which a blockade portion was provided on an outer end surface of each sealing portion were prepared wherein the gap between the sealing portion made of quartz glass and the perimeter surface of the lead rod made of molybdenum was filled with the sealing agent made of a rubidium oxide.

In addition, the manufacture method shown in the FIGS. 4A to 4D was applied to the sealing portions 12*a* and 12*b* of both sides.

<Discharge Lamp>

Maximum outer diameter of an arc tube portion: 10.0 mm
Internal volume: 85 $mm^3$
Length of the sealing portion: 18 mm
Maximum outer diameter: 6 mm
Length of a lead rod: 40 mm
Outer diameter: 0.7 mm
Length of a metallic foil: 10 mm
Width thereof: 1.5 mm
Rated voltage: 75 V
Rated electric power: 150 W
Amount of enclosed mercury: About 20 mg The second experiment using the discharge lamp of the above-mentioned example according to the present invention is explained below.

In this experiment, a lamp unit in which a reflector was disposed as shown in FIG. 7 was used, and a process in which the lamp was turned off for 15 minutes after lighting for 165 minutes, was repeated and time until the lamp could not be turned on was measured. The existence of problems, such as cracks of the sealing portion, were observed by visual observation simultaneously.

In this case, the temperature of the sealing portion 12*a* on the side of front glass 34 was 570 degrees Celsius.

Consequently, these three discharge lamps according to the example of the present invention were good in lighting even after passage of 930 hours, 1040 hours, and 1040 hour respectively, and, it was confirmed, respectively that the appearance of the sealing portion was also satisfactory.

In the above example according to the present invention, both of sealing portions are filled with sealing agent and blockage portions are formed on the respective portions. However, according to the present invention, only one of the sealing portions may be filled with sealing agent and a blockage portion is formed thereon.

According to this invention, in the lamp which has a sealing portion in which a metallic foil is buried, a gap formed between the sealing portion and the lead rod is filled with sealing agent made of rubidium oxide or cesium oxide and a blockage portion is provided on an outer end surface of at least one of the sealing portions.

Since the lead rod and metallic foil exposed to oxidation environment is shut out from the air, it is possible to provide a lamp, which has a sealing portion(s) with a high heat-resistant temperature and a long use life.

Thus, the present invention possesses a number of advantages or purposes, and there is no requirement that every claim directed to that invention be limited to encompass all of them.

The disclosure of Japanese Patent Application No. 2003-109326 filed on Apr. 14, 2003 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A foil sealed lamp in which a lamp container made of transparent material, has at least one sealing portion made of molybdenum wherein a metallic foil is buried, a light emitting section which is connected to one end of the metallic foil and a lead rod extending outward and connected to other end of the metallic foil, wherein, in the sealing portion, a gap formed around a circumference portion of the lead rod is filled with sealing agent made of rubidium oxide or cesium oxide, and glass having boron oxide and bismuth oxide as principal components is coated on an outer end surface of the sealing portion so as to close the gap.

2. A foil sealed lamp in which a lamp container made of transparent material, has at least one sealing portion made of molybdenum wherein a metallic foil is buried, a light emitting section which is connected to one end of the metallic foil and a lead rod extending outward and connected to other end of the metallic foil, the foil sealed lamp, wherein in the sealing portion, a gap formed around a circumference portion of the lead rod is filled with an aqueous solution of rubidium nitrate or cesium nitrate, and a heat-treatment of the sealing portion is carried out so as to form sealing agent made of rubidium oxide or cesium oxide in the sealing portion, and glass having boron oxide and bismuth oxide as principal components is coated on an outer end surface of the sealing portion so as to close the gap.

* * * * *